US006740013B2

(12) United States Patent
Werner

(10) Patent No.: US 6,740,013 B2
(45) Date of Patent: May 25, 2004

(54) DYNAMIC ENERGY CONVERTER

(76) Inventor: Gary V. Werner, 4125 W. Pine St., Appleton, WI (US) 54914

( * ) Notice: Subject to any disclaimer, the term of this patent is extended or adjusted under 35 U.S.C. 154(b) by 35 days.

(21) Appl. No.: 10/054,464

(22) Filed: Jan. 24, 2002

(65) Prior Publication Data

US 2002/0065177 A1 May 30, 2002

Related U.S. Application Data

(60) Provisional application No. 60/240,044, filed on Oct. 16, 2000.

(51) Int. Cl.[7] ..... A63B 23/12
(52) U.S. Cl. ..... 482/110; 482/92
(58) Field of Search ..... 482/110, 92, 904, 482/126, 148, 44–49; 446/253

(56) References Cited

U.S. PATENT DOCUMENTS

| | | | | | |
|---|---|---|---|---|---|
| 3,672,094 | A | * | 6/1972 | Vigorito | 446/253 |
| 3,737,162 | A | * | 6/1973 | Wood | 482/110 |
| 4,953,854 | A | * | 9/1990 | Pizur, Sr. | 482/148 |
| 5,512,028 | A | * | 4/1996 | Sparks, III | 482/92 |
| 5,674,159 | A | * | 10/1997 | Davidson | 482/92 |

* cited by examiner

*Primary Examiner*—Stephen R. Crow
(74) *Attorney, Agent, or Firm*—Russell L. Johnson Patent Agent

(57) ABSTRACT

A dynamic energy converter is provided as an exercise and amusement apparatus. The physics of a torsion pendulum and button and string child's toy are employed in to provide a novel mode of exercise. An inertial component of significant mass and diameter has a flexible strand or cord of significant strength threaded through holes in the inertial component and formed into a closed loop. A means for gripping the ends of the loop of cord so that the inertial element is midway between the gripping means is attached to the loop. The user of the apparatus twirls the inertial element to create twists in the cord and then applies opposed tension to the cord to cause the inertial component to rotate as the twists in the cord unwind. The inertia of the inertial element under controlled tension causes the cord to unwind and then wind in the opposite direction until increased tension in the cord causes the inertial component to rotate and accelerate in the opposite direction. The dynamic and continuously changing tensions provided by the user to keep the inertial component moving in oscillating cycles is a form of exercise that conditions and tones the muscles for activities where controlled acceleration and deceleration are required for a high level of performance.

1 Claim, 2 Drawing Sheets

DYNAMIC ENERGY CONVERTER

CROSS REFERENCE TO RELATED APPLICATIONS

This patent application claims the benefits of U.S. Provisional patent application, Ser. No. 60/240,044, filed Oct. 16, 2000, titled Dynamic Energy Converter

BACKGROUND

Field of the Invention

This invention relates to an apparatus that combines aspects of an amusement device with those of an exercise device. More specifically, the apparatus of this invention employs the basic mechanisms and physics of a button and string child's toy with modern technologies to provide an amusement and exercise device that provides entertainment and versatility while providing a means for achieving beneficial exercise.

Many toys and games provide beneficial exercise along with entertainment and amusement. The jump rope, for example, began as a child's toy or amusement device and is now a widely used exercise device.

The homemade toy comprising a button threaded on a loop of string has for many decades provided entertainment for children while the exercise potentials of the toy have gone unrecognized.

As commonly used, the ends of a loop of string that passes through a button are placed on the thumbs of the user and the button is centered on the loop. The button is twirled to create twists in the string to either side of the button. By pulling outward with the thumbs, the button is caused to rotate on the loop, as the twists are unwound. When the twists are nearly fully unwound and the angular velocity of the button is near its maximum, the tension of the string is relaxed and the momentum of the button causes it to twist the string in the opposite direction from that of its initial twist. When the twisting is nearing its completion and the inertia of the button is near exhaustion, the tension in the string is again asserted by pulling outward with the thumbs and the button is urged to counter rotate and accelerate due to the input of the pulling energy exerted by the thumbs. The cycle of input pulses of energy and the winding and unwinding of the string are repeated, providing amusement and entertainment to the user.

The potentials of this mechanism as a beneficial exercise apparatus are not apparent due to the small size and mass of buttons and the limited numbers of locations of the buttonholes. A second limiting deficiency in these early toys was that when higher levels of energy were developed in the system, the string tended to tighten around the thumb of the user to the degree that it was capable of causing pain and injury and thoughts of introducing more energy into the system were discouraged.

The apparatus of this invention overcomes the deficiencies described above and provides a larger and more versatile dynamic energy converter than has heretofore been known in the art.

In general, opposed tension exercisers are not dynamic and rely on weights and/or springs or other resilient components to provide the opposing tension. The maintaining of the apparatus of this invention in motion requires the application of controlled dynamic tension which produces a different exercise experience than that provided by prior art opposed tension devices.

It is therefore an object of this invention to provide an amusement and exercise apparatus employing the basic concepts of the above described child's toy wherein the apparatus is provided with a gripping means and exchangeable and adjustable components so as to permit the user to develop energy levels in the system that will require, for their establishment and maintenance, energy inputs from the user at levels sufficient to provide beneficial physical exercise.

The apparatus of this device employs the mechanisms and physics of the child's toy along with more advanced technologies to provide an amusement and exercise apparatus that is versatile in use and which provides a means for providing beneficial exercise while developing the advanced skills needed to maintain the dynamics of the apparatus in motion in a variety of modes of use.

BRIEF SUMMARY OF THE INVENTION

In its simplest form the invention is an energy converting apparatus comprising: an inertial component having; a mass greater than one ounce, a diameter greater than two inches, a center of mass, an axis of revolution passing through the center of mass, a first passageway and a second passageway, passing through the inertial component parallel to the axis of revolution and spaced equal distant from the axis of revolution and intersecting a transverse line passing through the axis of revolution, at least one strand component having a first free end and a second free end, and the strand is passed through the first passageway and doubled back on itself and passed through the second passageway and the first free end and the second free end are releaseably joined to form a closed loop, and a first gripping means and a second gripping means secured by securement means to said strand component at opposite sides of said inertial component to form an energy converting apparatus having a closed loop of strand material with an inertial component threaded on the strand, material midway between a first gripping unit and a second gripping unit secured to said strand component.

The invention permits numerous changes in the principle components so as to permit the setting of the energy requirements for its operation through wide range for several of the variables built into the apparatus.

DETAILED DESCRIPTION

Figure 1:
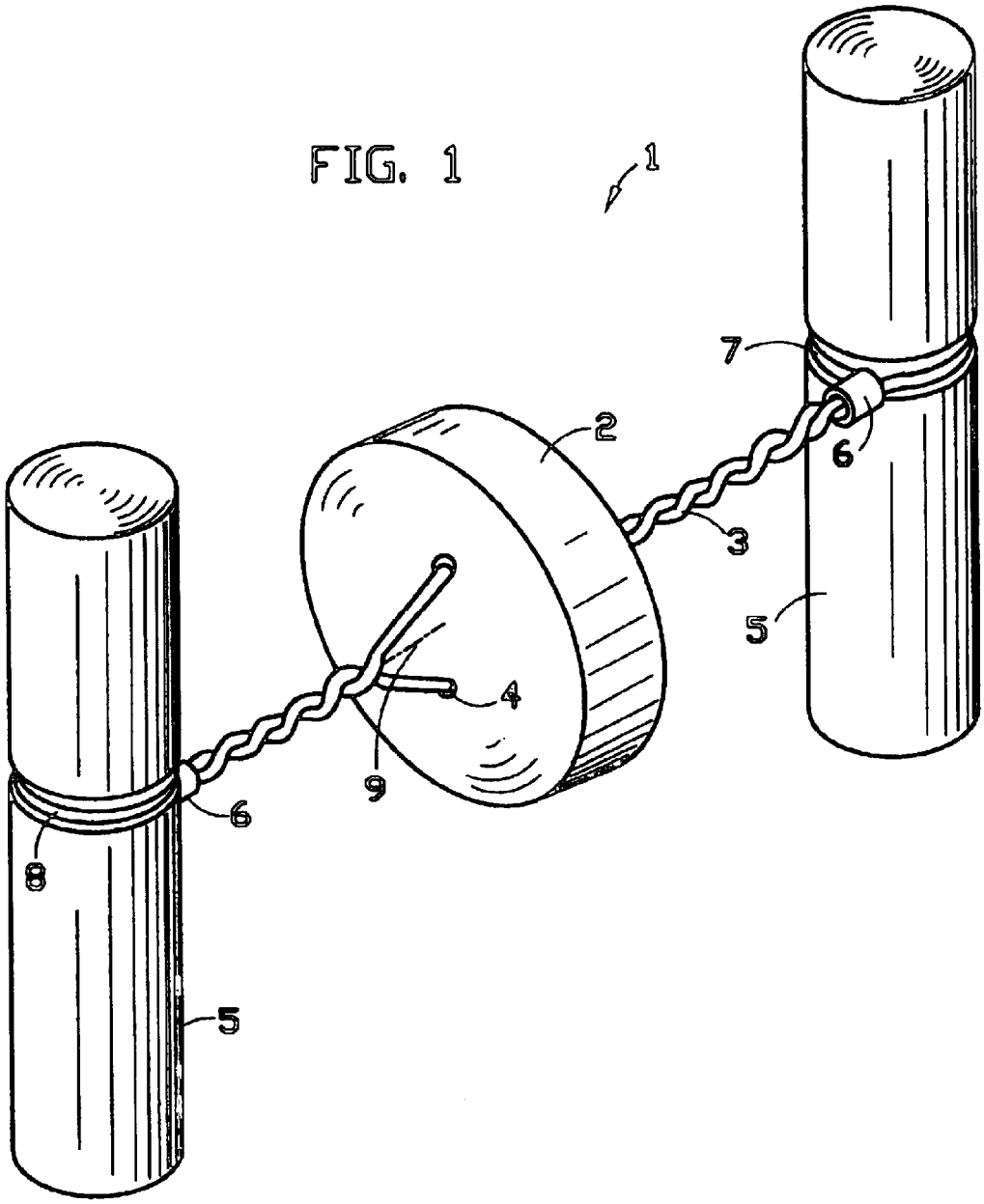
FIG. 1 is a pictorial view of an apparatus made according to this invention illustrating the components of the invention.

The inventor's analog to the button of the above-described child's toy is herein referred to as the inertial component of the invention.

The inventor' analog to the string of the above described child's toy is herein referred to as the strand component of the invention.

In the drawings like numbers refer to like objects and some proportions have been modified to facilitate illustration.

Referring now to FIG. 1 wherein a preferred embodiment of the invention is shown. Apparatus 1 is shown to have an inertial component 2 having an axis of revolution 9, a strand component 3, passing through passageways 4 of inertial component 2 and being looped around gripping means 5. Cinch 6 serves to attach strand component 3 in groove 7 of gripping means 5. Strand component 3 as shown in FIG. 1 is of a resilient weldable material, which is formed into a loop by means of weld 8.

Gripping means 5 provide a positive grip and serves to prevent injury when using the apparatus with an inertial component 2 of considerable mass and therefore having the capacity to exert considerable torque on strand component 3.

This invention is developed about the dynamics of the button and string child's toy but utilizes the inertial forces developed by inertial components that are larger in size and greater in mass than a button to provide an exercise and entertainment device. It has been found that unique and beneficial exercise can be obtained from the dynamic energy converter of this invention when the inertial component of the invention is at least two inches in diameter and has a mass of at least one ounce. The term "dynamic energy" as used herein refers to the continuously changing inputs of energy required to sustain the apparatus of this invention in motion. The energy inputs of opposed tensions in the twisted strand component accelerate the inertial component to rotate in one direction until the strand components are unwound and then the inertia of the inertial component twists the strand component in the opposite direction until the inertial energy built up in acceleration is dissipated in twisting the strand component in the opposite direction against opposed tension in the strand component. Increased opposed tension in the strand component accelerates the inertial component in the opposite direction and the cycles repeat. The dynamic forces applied by the user to the apparatus to maintain the inertial component in these cyclic accelerations and decelerations provides the user with controlled dynamic muscle conditioning that is particularly relevant to athletes who employ their muscles in controlled dynamic accelerations and decelerations in their activities. Dancers, gymnasts, basketball players, fencers and the like can benefit from this unique form of exercise.

The magnitude and duration of energy inputs required to maintain the apparatus in operation are affected by the size and mass of the inertial component, and the properties and lengths of the strand component.

Strand component 3 can be an inextensible flexible strand such as string or twine or it can be of a slightly resilient material such as nylon or a more resilient elastomeric material The resilient aspect of strand component 3 adds an hysteresis property to the operation of the apparatus 1 which requires additional skill and control to maintain the apparatus in dynamic rhythm. Strand component 3 may be formed into a loop by welding, knotting, or by other suitable joinder means such as a compression clip or the like, or strand component 3 may have its free ends secured to or in a gripping means.

Inertial component 2 is shown in FIG. 1 to have a disc shape. The apparatus of this invention is configured so that inertial component 2 may be replaced with a multiplicity of inertial components 2 much like weights are added to a bar of free weights or be replaced by an inertial component of greater diameter or mass or of differing shape. This level of versatility of the apparatus enables it to be tailored to the operator's level of strength, skill, and conditioning as well as permitting the changing of the amplitude and frequency of dynamic energy requirements for different modes of exercise.

Figures 2, 3:
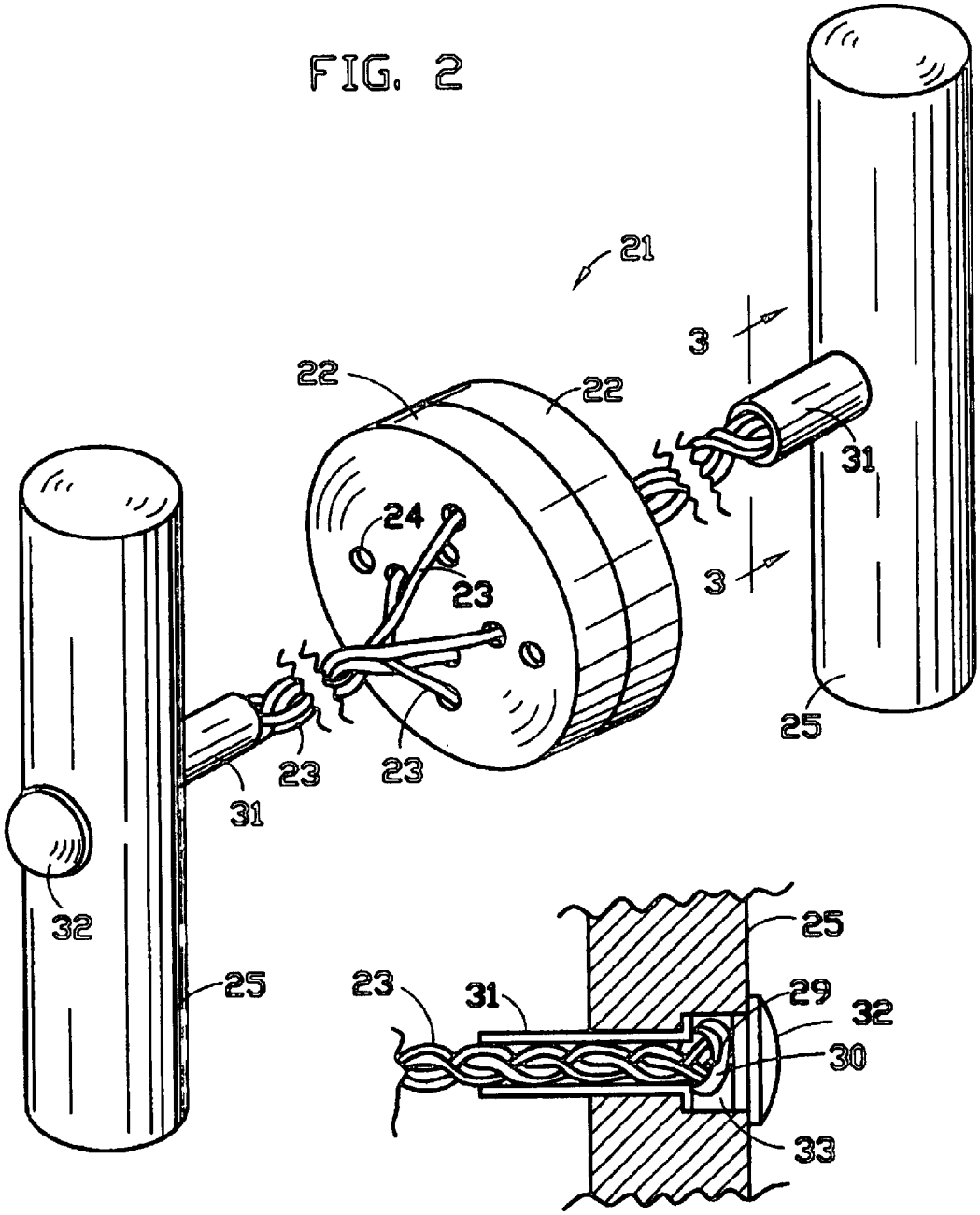
FIG. 2 is a pictorial view of a preferred embodiment of the apparatus of this invention.
FIG. 3 is a sectioned view of a portion of the gripping means of the apparatus of FIG. 2

Referring now to FIGS. 2 and 3 wherein a more sophisticated embodiments of the apparatus of FIG. 1 is shown. Apparatus 21 is provided with a multiplicity of inertial components 22 which define passageway 24 which permit a multiplicity of strand components 23 to be passed through inertial components 22. Strand components 23 may have free ends 29 knotted together in releasable knot 30 which permit the adding and subtracting and repositioning of strand components 23 to and from inertial component 22 and thereby modify the operating characteristics of apparatus 21.

Gripping means 25 is here shown as a handle defining a counterbored anchoring seat 33 into which a flanged tube 31 is inserted and through which strand components 22 are passed and then knotted together to form knot 30 which bears against the flange of flanged tube 31. A cap 32 is provided to prevent knot 30 from escaping from counterbored seat 33.

In use, the user of apparatus 21 is provided with options in the characteristics of inertial component 21 such as size shape, mass, and number and distribution of passageways in the inertial component. The user is further provided with options in the number, length and physical properties of strand components. The user is further provided with options in the shape and mode of use of gripping components. It can be appreciated that to set forth the possible combinations of components and their properties would greatly multiply the drawings and render the drawings and claims prolix.

The disclosures and specifications, above, teach the concepts and components of the instant invention and are representative of the means available for practicing this invention without departing from the concepts that underlie this invention. Therefore the scope of this invention should not be limited by the contents of the above disclosures but the scope of this invention should be seen to encompass all equivalents thereto that would be made obvious thereby to one skilled in the art.

What is claimed is:

1. An energy converting apparatus comprising:

a) a multiplicity of inertial components, each component having a mass greater than one ounce and a diameter greater than 2 inches, a center of mass, an axis of revolution passing through the center of mass, a multiplicity of pairs of passageways, each pair having a first passageway and a second passageway, passing through the inertial component parallel to the axis of revolution and spaced equal distant from the axis of revolution and intersecting a transverse line passing through the axis of revolution, b) a multiplicity of strand components having a first free end and a second free end, and pairs of strand components are passed through pairs of passageways in the inertial components and the free ends of the strand components are joined to form a bundle of free ends one to each side of the inertial components, c) a first gripping means and a second gripping means secured by securement means to said strand component at opposite sides of said inertial component to form an energy converting apparatus having closed loops of strand material with inertial components threaded on the strand material midway between a first gripping means and a second gripping means secured to said strand component, and d) the gripping means defines a counterbored hole that passes through said gripping means and into which is inserted a flanged tube and through which free ends of strand components are inserted and thereafter knotted to form a knot that rests against the flange of the flanged tube and in the counterbore.

* * * * *